US010143291B2

(12) United States Patent
Chibas

(10) Patent No.: US 10,143,291 B2
(45) Date of Patent: Dec. 4, 2018

(54) COSMETIC CASE AND DISPENSER ASSEMBLY

(71) Applicant: Diana Dalia Chibas, Pembroke Pines, FL (US)

(72) Inventor: Diana Dalia Chibas, Pembroke Pines, FL (US)

(73) Assignee: REAL SUPERSTAR BEAUTY, LLC, Pembroke Pines, FL (US)

( * ) Notice: Subject to any disclaimer, the term of this patent is extended or adjusted under 35 U.S.C. 154(b) by 10 days.

(21) Appl. No.: 15/479,023

(22) Filed: Apr. 4, 2017

(65) Prior Publication Data

US 2018/0279742 A1 Oct. 4, 2018

(51) Int. Cl.

| | |
|---|---|
| ***A45D 40/24*** | (2006.01) |
| ***A45D 40/22*** | (2006.01) |
| ***A45D 42/02*** | (2006.01) |
| ***A45D 33/00*** | (2006.01) |
| ***A45D 33/18*** | (2006.01) |

(52) U.S. Cl.

CPC ..... *A45D 40/24* (2013.01); *A45D 33/003* (2013.01); *A45D 33/18* (2013.01); *A45D 40/22* (2013.01); *A45D 42/02* (2013.01)

(58) Field of Classification Search

CPC ..... A45D 40/24; A45D 40/22; A45D 33/003; A45D 33/18; A45D 33/28; A45D 33/26; A45D 42/02; B65D 81/3876; B65D 81/38

USPC ..... 220/23.89, 23.88, 23.87, 23.83, 23.86, 220/739, 737

See application file for complete search history.

(56) References Cited

U.S. PATENT DOCUMENTS

| | | | | |
|---|---|---|---|---|
| 2,547,971 A * | 4/1951 | Polin | A45D 33/28 132/297 |
| 4,562,923 A * | 1/1986 | Katada | A45D 40/24 132/314 |
| 4,798,310 A * | 1/1989 | Kasai | B43K 23/001 206/224 |
| 5,116,154 A | 5/1992 | Fulkerson | |
| 5,301,808 A * | 4/1994 | Pierson | A45D 40/24 132/297 |
| 6,796,431 B1 | 9/2004 | Goldring | |
| 6,827,516 B2 | 12/2004 | Gutberlet | |

(Continued)

*Primary Examiner* — Tatiana Nobrega
*Assistant Examiner* — Brianne Kalach
(74) *Attorney, Agent, or Firm* — Johnson | Dalal; Mark C. Johnson

(57) ABSTRACT

A cosmetic case and dispenser assembly that includes a cosmetic case cover coupled to a cosmetic case body, in which cosmetic items may be stored within sleeved cosmetic enclosures disposed within independent channels of the cosmetic case body. The sleeved cosmetic enclosures are selectively translatably coupled to platform assemblies disposed within the independent channels of the cosmetic case body, and that allow for the sleeved cosmetic enclosures to translate from a first position to a second position, in which the second position is extended away from the cosmetic case body. A user can efficiently store and easily access cosmetic items within each of the sleeved cosmetic enclosures in the independent channels, and can eject each of the sleeved cosmetic enclosures by applying a force to compress a spring housed within the cosmetic case body, consequently and translating the sleeved cosmetic enclosure out of the cosmetic case and dispenser assembly.

20 Claims, 26 Drawing Sheets

(56) References Cited

U.S. PATENT DOCUMENTS

| | | | | |
|---|---|---|---|---|
| 7,429,141 | B2 | 9/2008 | Habatjou | |
| 7,614,404 | B2 | 11/2009 | Kee | |
| 7,753,608 | B2 * | 7/2010 | Hsing | A45D 40/20 206/385 |
| 2010/0236567 | A1 | 9/2010 | Carroll et al. | |
| 2012/0114409 | A1 | 5/2012 | Chiang | |
| 2015/0201733 | A1 * | 7/2015 | Brogoitti | A45D 33/28 132/288 |
| 2016/0023500 | A1 * | 1/2016 | Wang | B43K 23/04 401/131 |
| 2016/0324297 | A1 * | 11/2016 | Moore | A45D 40/24 |
| 2017/0095059 | A1 * | 4/2017 | Gajjar | A45D 40/22 |

* cited by examiner

100

206

1600

COSMETIC CASE AND DISPENSER ASSEMBLY

FIELD OF THE INVENTION

The present invention relates generally to cosmetic cases, and, more particularly, relates to a cosmetic case that is operably configured to dispense one or more cosmetic items.

BACKGROUND OF THE INVENTION

Due to the hectic daily schedules of modern society, users of cosmetic items do not always have the time to apply cosmetic items within the spacious confines of a bathroom. As a result, portable cosmetic cases have become a staple of life for many cosmetic item users, allowing the users to efficiently store and use cosmetic items at almost any time and in almost any place. A variety of portable cosmetic cases currently exist, having different orientations and features. Many of the currently available cases contain a portion for storing various cosmetic products, such as foundation or blush. A user can use this storage portion to efficiently store and subsequently apply cosmetic items. Further, a variety of cosmetic items, such as mascara and eyeliner, are sold within self-contained cases. Users can store these cosmetic items without the fear of the items breaking or spilling within a container, such as a bag or a purse.

While users can store cosmetic items within a bag or a purse, they are often loosely stored within a bag or a purse, forcing the user to reach into the container and struggle to find and retrieve the cosmetic items in an efficient manner. Further, while a variety of portable cosmetic cases currently exist, they do not contain a portion for the storage of self-contained cosmetic items, such as mascara and eyeliner. Therefore, a user must take up space by storing a cosmetic case in addition to individual cosmetic items, subsequently creating an inefficient, messy, and bulky bag or purse.

Therefore, a need exists to overcome the problems with the prior art as discussed above.

SUMMARY OF THE INVENTION

The invention provides a cosmetic case and dispenser assembly that overcomes the hereinafore-mentioned disadvantages of the heretofore-known devices and methods of this general type and that effectively and efficiently operates to store and dispense one or more various types of cosmetic items, e.g., lipstick, eyeliner, etc.

With the foregoing and other objects in view, there is provided, in accordance with the invention, a cosmetic case and dispenser assembly that includes a cosmetic case cover having an upper surface and a bottom surface opposing the upper surface of the cosmetic case cover and a cosmetic case body with the cosmetic case cover selectively removably coupled thereto. The cosmetic case body has a first end, a second end, and a body length separating the first and second ends of the cosmetic case body and has a bottom surface and an upper surface defining an upper cavity thereon. The cosmetic case cover is operably configured to enclose the upper cavity when placed in a closed position along a cover translation path. The case body also defines a plurality of independent channels, with each respectively spanning in a direction from a first end aperture defined by the first end of the cosmetic case body toward the second end of the cosmetic case body and interposed between the upper cavity and the bottom surface of the cosmetic case body. The plurality of independent channels also each span a length at least greater than 50% the body length. The assembly also includes a plurality of platform assemblies, with each respectively disposed within one of the plurality of independent channels proximal to the second end of the cosmetic case body, and a plurality of sleeved cosmetic enclosures. The plurality of sleeved cosmetic enclosures are each respectively disposed within the plurality of independent channels and have a cap selectively removably coupleable thereto, are selectively translatably coupled to one of the plurality of platform assemblies, have a first position along a sleeved cosmetic enclosure translation path with an upper surface of the cap disposed a first cap-offset-length from the one of the plurality of platform assemblies and at least one of proximal to and recessed within the first end of the cosmetic case body and also have a second position along the sleeved cosmetic enclosure translation path with an upper surface of the cap disposed a second cap-offset-length from the one of the plurality of platform assemblies. The second cap-offset-length is greater than the first cap-offset-length and the sleeved cosmetic enclosure translation path is limited by the one of the plurality of platform assemblies.

In accordance with another feature, an embodiment of the present invention includes the second position having the upper surface of the cap disposed in an ambient environment a length spatially removed from the first end of the cosmetic case body.

In accordance with a further feature of the present invention, the upper surface of each cap coupled to the plurality of sleeved cosmetic enclosures includes a cosmetic classification indicia disposed thereon, wherein each cosmetic classification indicia has an independent visual representation corresponding to a cosmetic classification group, e.g., lipstick.

In accordance with yet another feature, an embodiment of the present invention includes each of the plurality of platform assemblies respectively including a spring disposed therein that is operably configured to compress and apply a force on one of the plurality of sleeved cosmetic enclosures in a direction toward the first end of the cosmetic case body.

In accordance with a further feature of the present invention, each of the plurality of sleeved cosmetic enclosures are respectively selectively translatably coupled to the one of the plurality of platform assemblies through a cam assembly. The cam assembly may include a cam arm with a first end mechanically coupled to the one of the plurality of platform assemblies and a cyclical cam path defined by each of the respective plurality of sleeved cosmetic enclosures. Additionally, the cyclical cam path may be defined by an outer surface of each of the respective plurality of sleeved cosmetic enclosures, wherein the cyclical cam path has a second end of the cam arm disposed within the one of the respective plurality of sleeved cosmetic enclosures and is operably configured to revolve therein.

In accordance with a further feature, another embodiment of the present invention includes the cosmetic case cover having a mirror disposed on the bottom surface of the cosmetic case cover.

In accordance with another feature of the present invention, the cosmetic case cover is hingedly coupled to the cosmetic case about a joint disposed proximal to a first outer longitudinal edge of the cosmetic case cover and a first longitudinal outer edge of the cosmetic case body.

In accordance with yet another feature, an embodiment of the present invention also includes each of the plurality of platform assemblies having a snap tab, wherein each of the respective plurality of platform assemblies are selectively removably coupled to a bottom end of each of the respective plurality of cosmetic sleeve enclosures with the snap tab.

In accordance with another feature, an embodiment of the present invention also includes the second position having the upper surface of the cap disposed in an ambient environment a length spatially removed from the first end of the cosmetic body.

In accordance with a further feature, the first sleeved cosmetic enclosure and the second sleeved cosmetic enclosure are each respectively translatably coupled to each of the first platform assembly and the second platform assembly through a first cam assembly and a second cam assembly.

In accordance with an additional characteristic, an embodiment of the present invention also includes the first cam assembly and the second cam assembly each respectively having a cam arm with a first end mechanically coupled to either the first platform assembly or the second platform assembly, wherein the cam arm defined by a cam arm length, and include a cyclical cam path defined by each of the respective first sleeved cosmetic enclosure and second sleeved cosmetic enclosure. In one embodiment, the cyclical cam path is defined by an outer surface of each of the respective first sleeved cosmetic enclosure and second sleeved cosmetic enclosure, wherein the cyclical cam path has a second end of the cam arm disposed within either the first sleeved cosmetic enclosure or the second sleeved cosmetic enclosure and is operably configured to revolve therein.

In accordance with yet another feature, an embodiment of the present invention includes the first sleeved cosmetic enclosure and the second sleeved cosmetic enclosure each respectively translatably coupled to each of the first platform assembly and the second platform assembly through a first cam assembly and a second cam assembly, wherein the first cam assembly and the second cam assembly each respectively have a cam arm with a first end mechanically coupled to either the first platform assembly or the second platform assembly and wherein the cam arm is defined by a cam arm length and the snap tab length is greater than the cam arm length.

In accordance with a further feature of the present invention, the cap also includes an outer surface and an inner surface opposite the outer surface. The inner surface may be made of a silicone material and may define an inner surface cavity. The inner surface of the cap may be operably configured to frictionally retain a cosmetic item within the inner surface cavity.

Although the invention is illustrated and described herein as embodied in a cosmetic case and dispenser assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the body length of the cosmetic case body of the cosmetic case and dispenser assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

The present invention provides a novel and efficient cosmetic case and dispenser assembly. Embodiments of the invention provide a user with the ability to efficiently store and retrieve cosmetic items from a cosmetic case by using removable sleeved cosmetic enclosures housed within independent channels. In addition, embodiments of the invention provide indicia on caps of the sleeved cosmetic enclosures, allowing the user to quickly identify the cosmetic item stored within each sleeved cosmetic enclosure.

Figure 1:
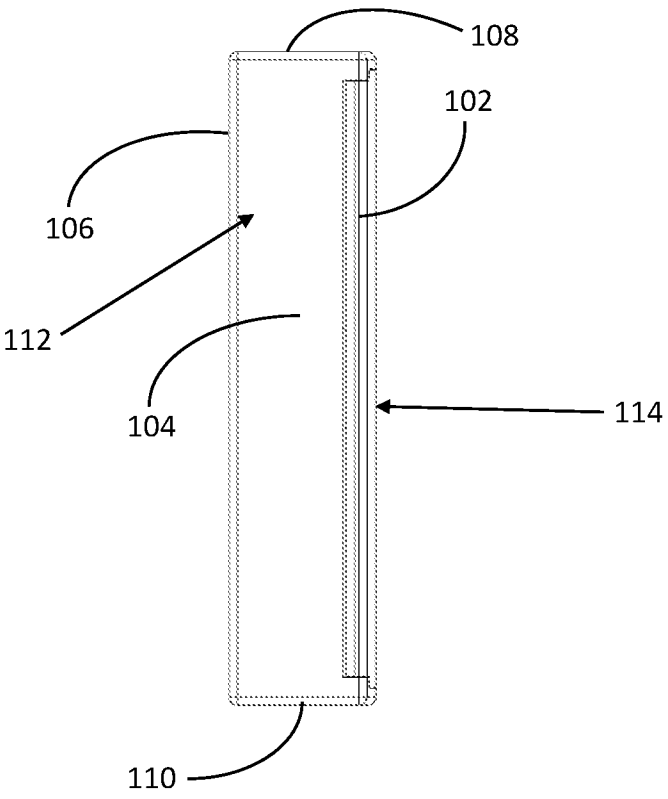
FIG. 1 is a front elevational view of a cosmetic case and dispenser assembly.

Referring now to FIG. 1, one embodiment of the present invention is shown in a front elevational view. FIG. 1 shows several advantageous features of the present invention, but, as will be described below, the invention can be provided in several shapes, sizes, combinations of features and components, and varying numbers and functions of the components. The first example of a cosmetic case and dispenser assembly 100, as shown in FIG. 1, includes a cosmetic case cover 102 that may be selectively removably coupled to a cosmetic case body 104.

Referring now to FIGS. 1-5, the cosmetic case cover 102 is shown in greater detail. In one embodiment of the present invention, the cosmetic case cover 102 may include an upper surface 114 and a bottom surface 502 opposing the upper surface 114. The cover 102 and body 104 may be made of a variety of materials, including, but not limited to, polymer, ceramic, or metal. In one embodiment, the bottom surface 502 may include a mirror 504. In another embodiment, the bottom surface 502 may consist entirely of the mirror 504. In one embodiment, the bottom surface 502 may be a flat surface. The bottom surface 502 may also be non-planar. In another embodiment, the bottom surface 502 may include storage portions that may be used to store items, such as cosmetic materials. As used herein, "cosmetic materials" includes, but is not limited to, powders, foundation, bronzers, eye shadow, and other cosmetics typically used to enhance the appearance or fragrance of a user.

The shape of the cosmetic case body 104 is also shown in greater detail in FIGS. 1-5. In one embodiment of the present invention, the cosmetic case body 104 may include a first end 108 and a second end 110, separated by a body length 404. In one embodiment, the body length 404 may be substantially similar in length to the cosmetic case cover 102. In one embodiment, the body length 404 may be approximately 6.5", plus or minus approximately 1". Other lengths of the body 102, however, may vary. The cosmetic case body 104 may also include a bottom surface 106 opposite an upper surface 506. In one embodiment, the upper surface 506 may include an upper cavity 508, providing for a storage compartment for items, such as cosmetic materials.

Referring now to FIGS. 8-16, various components of the cosmetic case body 104 are shown in greater detail. The cosmetic case body 104 may define a plurality of independent channels 1100*a-n* (wherein "a" represents the numeral one and "n" represents any number greater than one), spanning from the first end 108 to the second end 110. The plurality of independent channels 1100*a-n* are sized and shaped to receive a plurality of sleeved cosmetic enclosures 1000*a-n*, providing for the storage of the sleeved cosmetic enclosures 1000*a-n* within the cosmetic case body 104. The cosmetic case body 104 may also include a plurality of platform assemblies 1002*a-n*.

Figure 5:
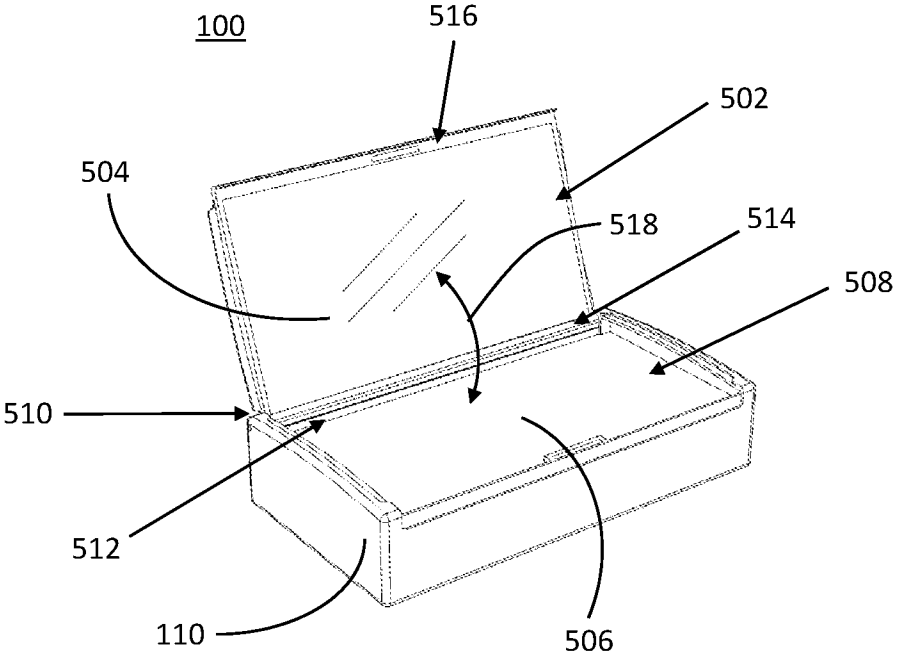
FIG. 5 is a perspective view of the cosmetic case and dispenser assembly of FIG. 1 with the top cover in an open configuration in accordance with the present invention.
Figure 9:
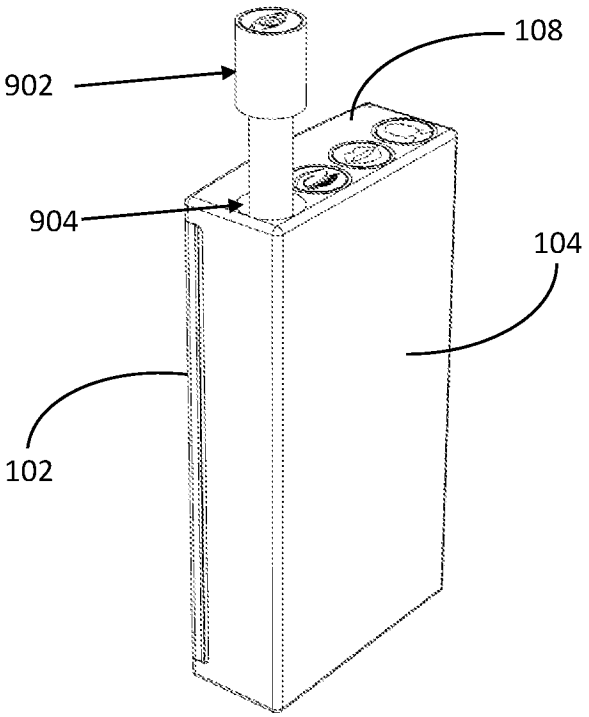
FIG. 9 is a perspective view of the bottom, front, and side of the cosmetic case and dispenser assembly of FIG. 1 with one of the caps in an extended configuration in accordance with the present invention.
Figure 10:
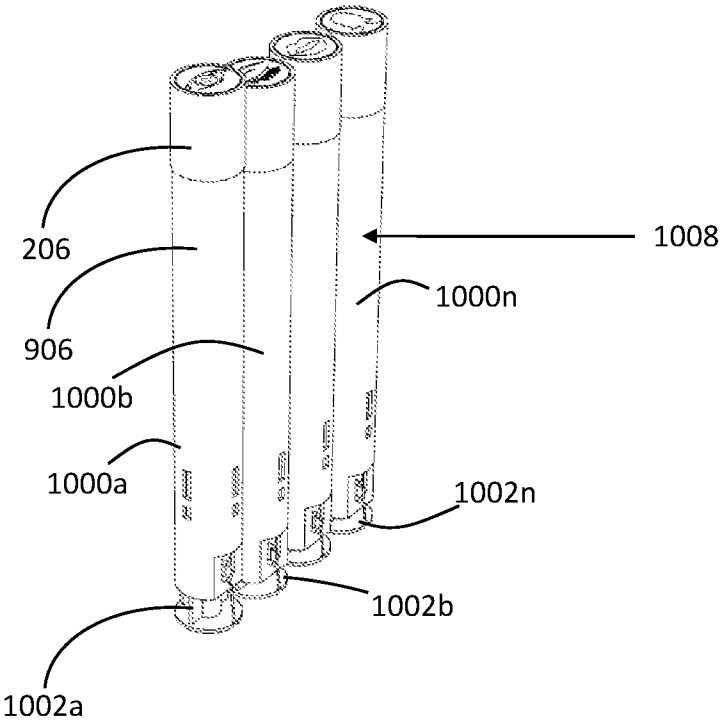
FIG. 10 is a perspective view of sleeved cosmetic enclosures of the cosmetic case and dispenser assembly of FIG. 1 with one of the caps in an extended configuration in accordance with the present invention.
Figure 11:
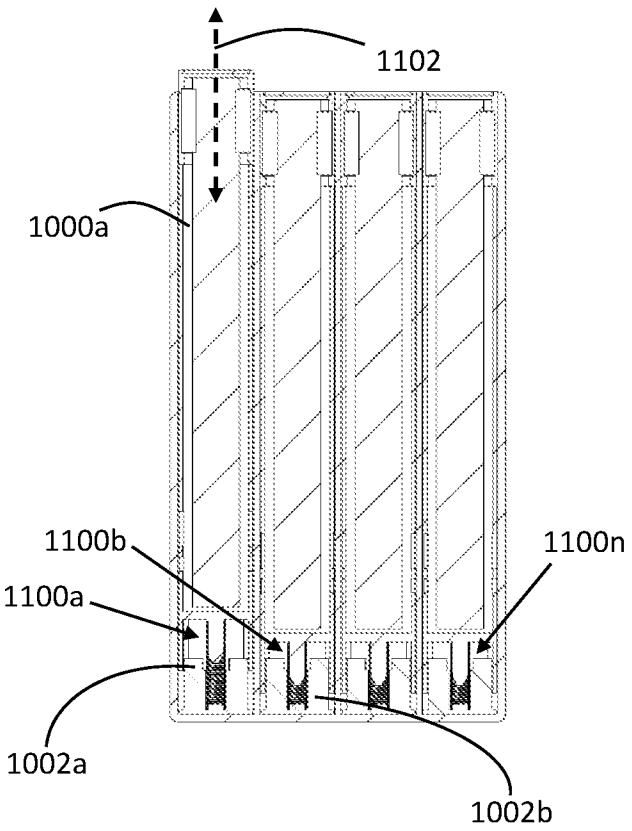
FIG. 11 is a cross-sectional view of the cosmetic case and dispenser assembly of FIG. 1, depicting the independent channels and sleeved cosmetic enclosures in accordance with the present invention.
Figure 12:
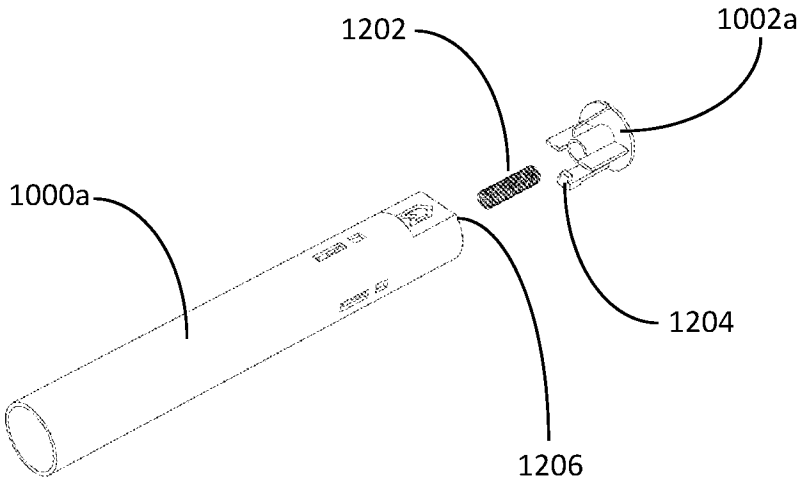
FIG. 12 is an exploded perspective view of one of the sleeved cosmetic enclosures of the cosmetic case and dispenser assembly of FIG. 1 in accordance with the present invention.
Figure 13:
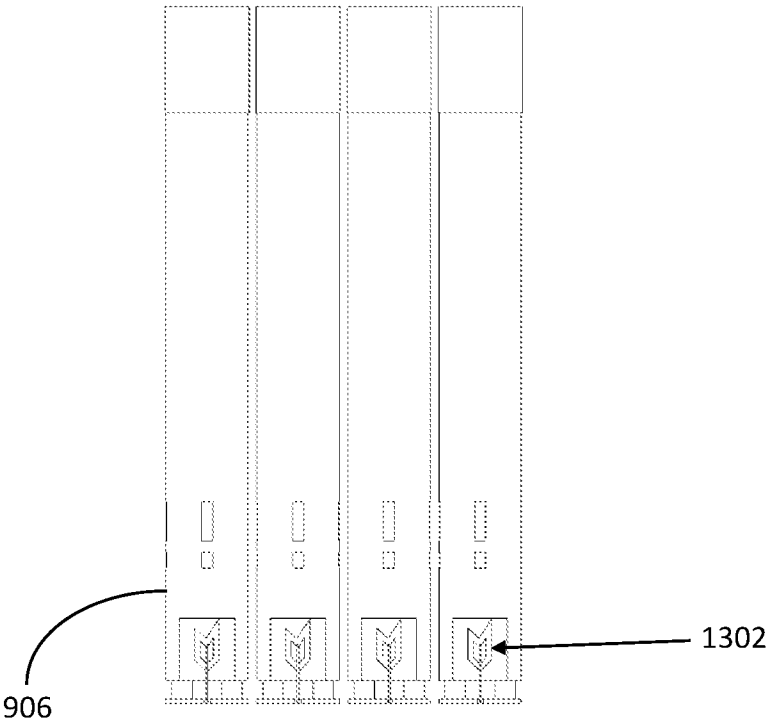
FIG. 13 is an elevational interior view of the sleeved cosmetic enclosures of the cosmetic case and dispenser assembly of FIG. 1 depicting a cam arm and cyclical cam path in accordance with the present invention.
Figure 14:
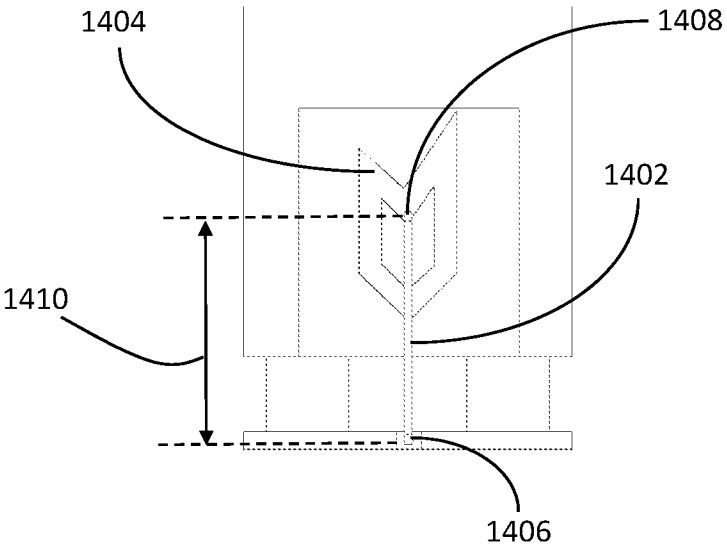
FIG. 14 is an elevational interior view of the cam arm and cyclical cam path of the cosmetic case and dispenser assembly of FIG. 1 in accordance with the present invention.

Referring now to FIGS. 9 and 11, with brief reference to FIG. 5, the plurality of independent channels 1100*a-n* are shown in greater detail. As used herein, "independent" means substantially spatially offset. Said another way, the cosmetic case body 104 contains more than one independent channel, as opposed to a single open space. In one embodiment, the first end 108 of the cosmetic case body 104 may define at least one first end aperture 904, exposing at least one of the plurality of independent channels 1100*a-n*, e.g., 904 (depicted in FIG. 9). In one embodiment, the plurality of independent channels 1100*a-n* may span from the first end aperture 904 toward the second end 110 of the cosmetic case body 104. In one embodiment, the plurality of independent channels 1100*a-n* may span a length at least greater than 50% of the body length 404 so as to effectively house a sufficient length of a cosmetic therein. In another embodiment, the plurality of independent channels 1100*a-n* may span a length less than or equal to 50% of the body length 404. In a preferred embodiment, the cosmetic case body 104 may include at least a first independent channel 1100*a* and a second independent channel 1100*b*. In another embodiment, the cosmetic case body 104 may include more than the first and second independent channels 1100*a-b*. The plurality of independent channels 1100*a-n* may be operably designed, or sized and/or shaped, to receive and store items within the cosmetic case body 104, such as the first sleeved cosmetic enclosure 1000*a* when inserted through the first end aperture 904. As such, in one embodiment, the plurality of independent channels 1100*a-n* may be interposed between the upper cavity 508 (as best seen in FIG. 5) and the bottom surface 106 of the cosmetic case body 104.

Figure 15:
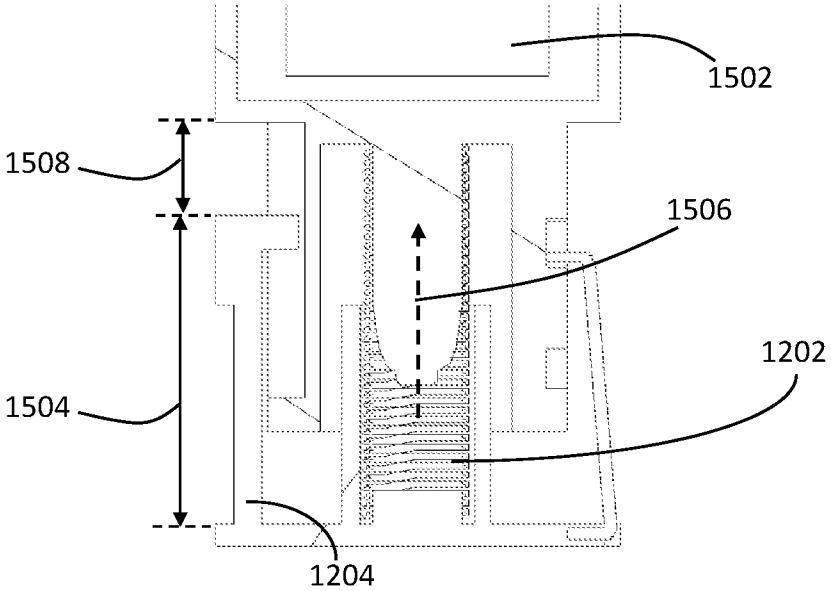
FIG. 15 is an elevational cross-sectional view depicting the use of the cosmetic case and dispenser assembly of FIG. 1 in accordance with the present invention.
Figure 16:
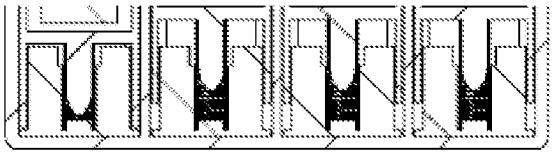
FIG. 16 is an elevational cross-sectional view of the platform assembly of the cosmetic case and dispenser assembly of FIG. 1 in accordance with the present invention.
Figure 17:
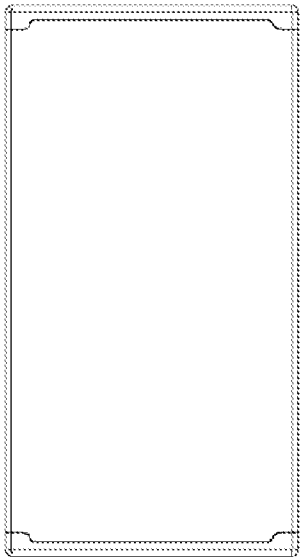
FIGS. 17-25 depict various views of the design of the cosmetic case and dispenser assembly of FIG. 1 in accordance with the present invention.
Figure 18:
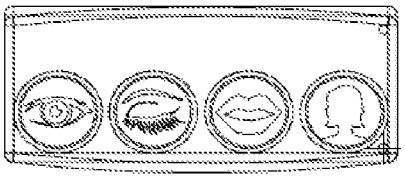
Figure 19:
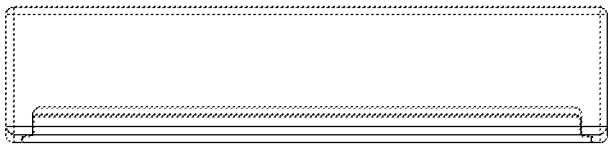
Figure 20:
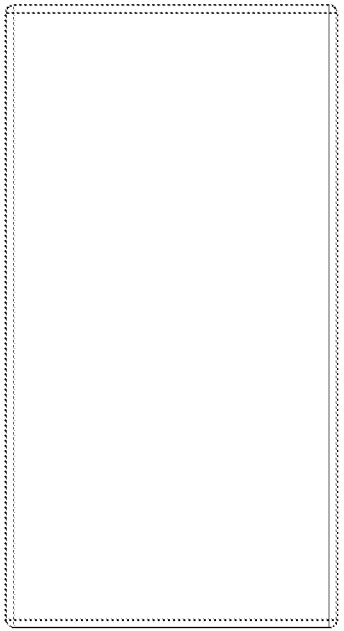
Figure 21:
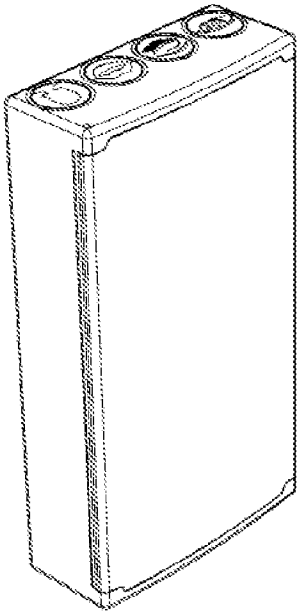
Figure 22:
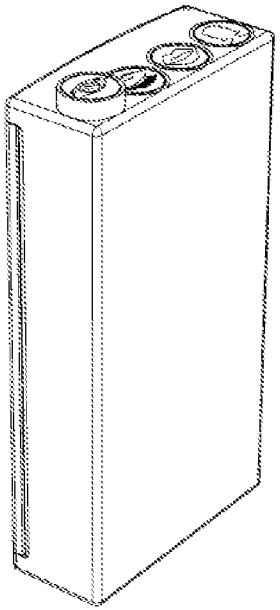
Figure 23:
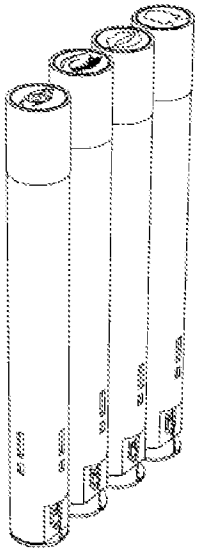
Figure 24:
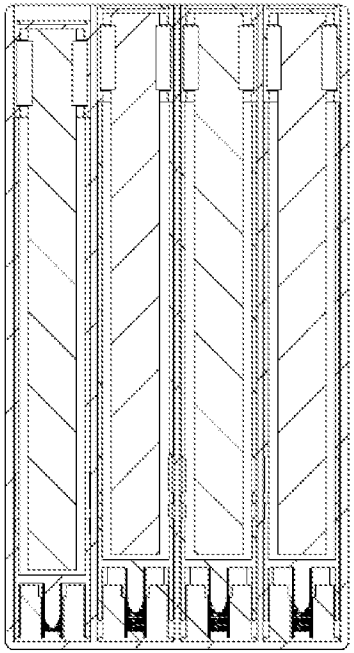
Figure 25:
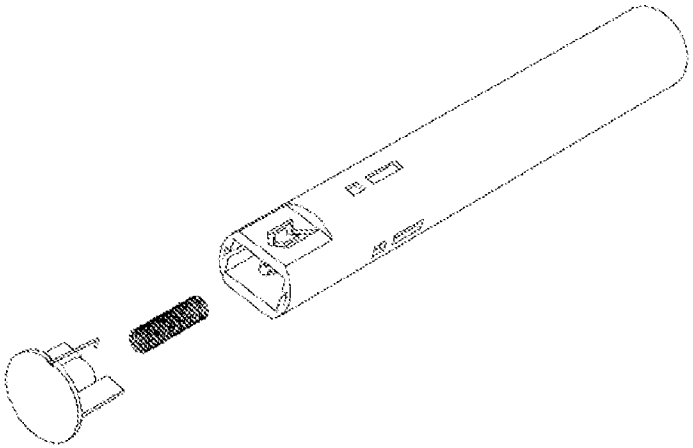

Referring now to FIGS. 9-12, with brief reference to FIG. 15, the plurality of sleeved cosmetic enclosures 1000*a-n* are shown in greater detail. In one embodiment, each of the plurality of sleeved cosmetic enclosures 1000*a-n* may be inserted within the cosmetic case body 104 through respective first end apertures, and respectively stored within one of the plurality of independent channels 1100*a-n*. As such, in one embodiment, each of the plurality of sleeved cosmetic enclosures 1000*a-n* may be of a length less than or substantially equal to the body length 404 of the cosmetic case body 104, allowing each of the plurality of sleeved cosmetic enclosures 1000*a-n* to be stored within, i.e., recessed, each of the plurality of independent channels 1100*a-n*. In one embodiment, the plurality of sleeved cosmetic enclosures 1000*a-n* may include at least a first sleeved cosmetic enclosure, e.g., enclosure 1000*a*, and a second sleeved cosmetic enclosure, e.g., enclosure 1000*b*. In one embodiment, the cosmetic case body 104 may include more than the first and second sleeved cosmetic enclosures 1000*a-b*, wherein there is preferably an enclosure for each channel defined by the body 104. Each of the plurality of sleeved cosmetic enclosures 1000*a-n* may include a bottom end 1206 and a cap 206 opposite the bottom end 1206. The cap 206 may be selectively removably coupled to one or more of the sleeved cosmetic enclosures 1000*a-n*. As used herein, the term "selectively removably coupled" means capable of being connected to, but removable from, a structure when desired by the user. The plurality of sleeved cosmetic enclosures 1000*a-n* may be sized and shaped to receive and store items, such as a cosmetic item 1502, and may be sized and shaped to be received by and stored within the plurality of independent channels 1100*a-n*. As used herein, "cosmetic item" includes, but is not limited to, lipstick, lip gloss, lip liner, mascara, eyeliner, foundation stick, contour stick, concealer, and the like. In one embodiment, the one or more channels 1100*a-n* are of a cylindrical shape and have a length of approximately 4" and a diameter of approximately 0.5" and the one or more enclosures 1000*a-n* are of a cylindrical shape and have a length of approximately 3.8" and a diameter of approximately 0.48". The cap 206 may be approximately 0.5" in length and have a diameter of approximately 0.48".

Figure 2:
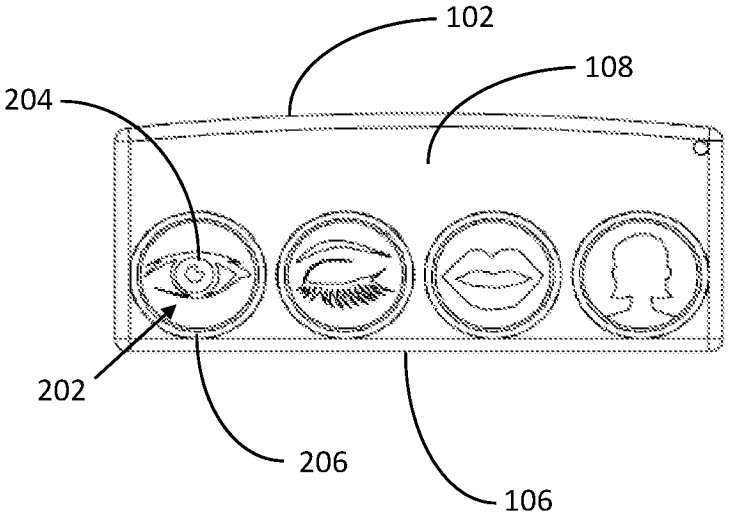
FIG. 2 is a side elevational view of the cosmetic case and dispenser assembly of FIG. 1 in accordance with the present invention.
Figure 3:
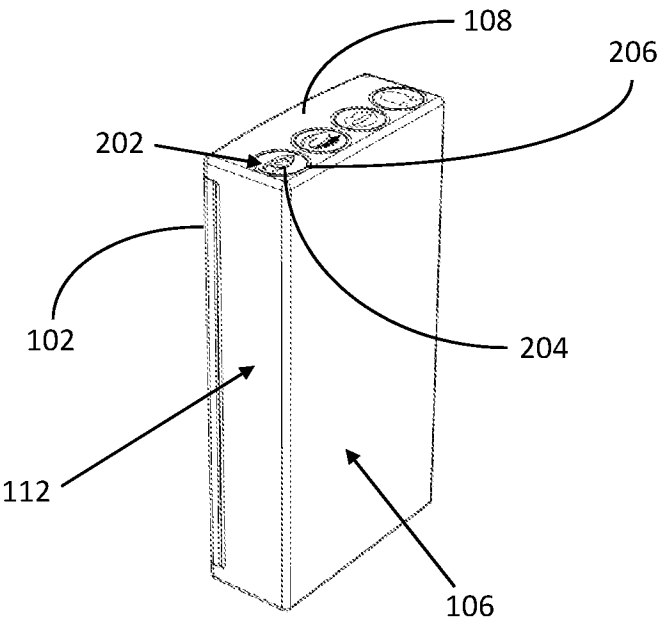
FIG. 3 is a perspective view of the bottom, front, and side of the cosmetic case and dispenser assembly of FIG. 1 in accordance with the present invention.
Figure 6:
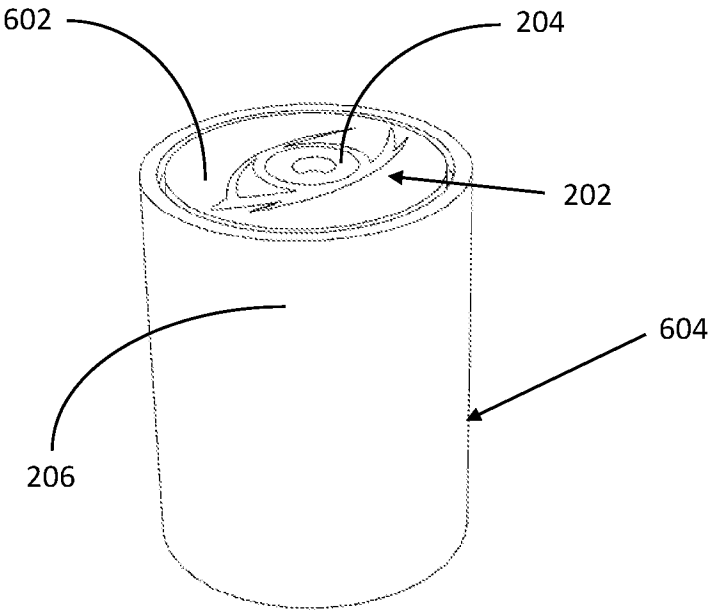
FIG. 6 is an elevational view of a cap of the cosmetic case and dispenser assembly of FIG. 1 in accordance with the present invention.
Figure 7:
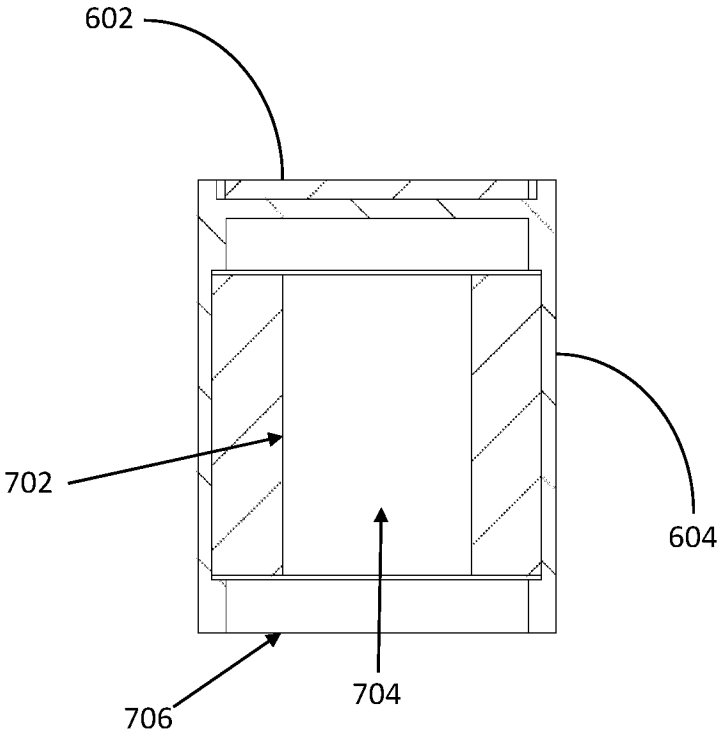
FIG. 7 is an elevational cross-sectional view of the cap of the cosmetic case and dispenser assembly of FIG. 1 in accordance with the present invention.
Figure 8:
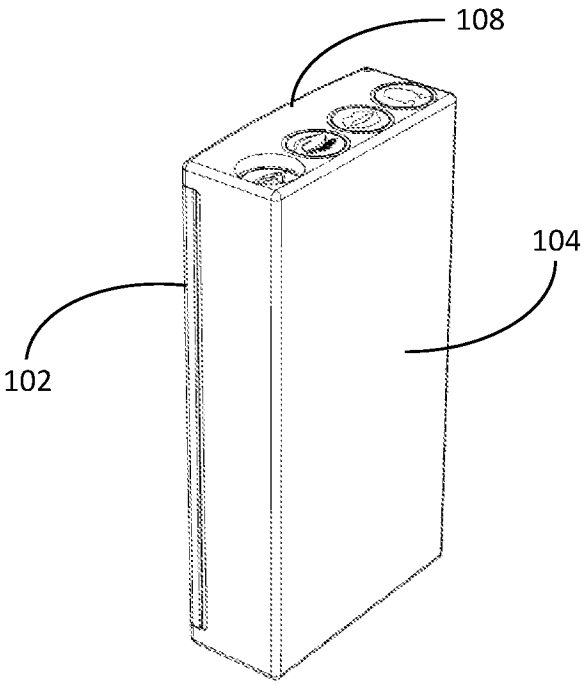
FIG. 8 is a perspective view of the bottom, front, and side of the cosmetic case and dispenser assembly of FIG. 1 with one of the caps in a depressed configuration in accordance with the present invention.

Referring now to FIGS. 2 and 6-7, with brief reference to FIG. 15, the cap 206 is shown in greater detail. In one embodiment, the cap 206 may be a solid and continuous piece of any material, including, but not limited to metal, plastic, ceramic, or other materials known by those of skill in the art. In another embodiment, the cap 206 may be two or more mechanically couplable pieces. As such, the pieces of the cap 206 may mechanically couple to one another, such as through an interlocking snap-on or tongue-and-groove configuration. In one embodiment, each cap 206 may be proximal, i.e., within approximately one to two inches, of the first end 108 of the cosmetic case body 104 when the enclosure to which it is attached is in a closed position along a sleeved cosmetic enclosure translation path (as discussed more fully below, but represented by arrow 1102). The cap 206 may also include an upper surface 602 that may include a cosmetic classification indicia 202 disposed thereon. In one embodiment, the cosmetic classification indicia 202 may include an independent visual representation corresponding to a cosmetic classification group 204. In a preferred embodiment, the independent visual representation corresponding to a cosmetic classification group 204 may be a symbol, marking, or word that indicates the contents of the particular sleeved cosmetic enclosure to which the cap 206 is disposed thereon.

In one embodiment, each cap 206 may include an outer side surface 604 and an inner surface 702 that may be opposite the outer side surface 604. In one embodiment, the inner surface 702 may define an inner surface cavity 704. In one embodiment, the inner surface 702 may be of a flexible material, such as silicone, in order to tightly grip or frictionally retain an item stored within the inner surface cavity 704, such as a cosmetic item 1502. As such, the cap 206 may consist of an outer shell that is of a substantially rigid material and a substantially elastic inner shell coupled thereto (using adhesive or other bonding material or method). Therefore, in one embodiment, the cosmetic items are specially designed to be frictionally retained with the confines the cap cavity defined by the inner surface 702. Said another way, the inner surface 702 and the cap 206 may be specially sized and shaped to receive the cosmetic item 1502 of a specialized and particular make and/or model. In other embodiments, the inner surface 702 and the cap 206 may be sized and shaped to receive the cosmetic item 1502 of any make and/or model. The bottom end 706 of the cap 206 may also include a portion operably configured to selectively removably couple with the upper end of one or more of the sleeved cosmetic enclosures 1000*a-n*. Various coupling configurations between the cap 206 and the enclosures 1000*a-n* include snap, tongue-and-groove, and/or friction-based configurations.

Referring now to FIGS. 10-16, the plurality of platform assemblies 1002*a-n* of the cosmetic case body 104 are shown in greater detail. In one embodiment, the cosmetic case body 104 may include at least a first platform assembly 1002*a* and a second platform assembly 1002*b*. In one embodiment, the cosmetic case body 104 may include more than the first and second platform assemblies 1002*a-b*. In one embodiment, at least one of the plurality of platform assemblies 1002*a-n* may be disposed within each of the plurality of independent channels 1100*a-n*. In one embodiment, at least one of the plurality of platform assemblies 1002*a-n* may be proximal to the second end 110 of the cosmetic case body 104. In one embodiment, the plurality of platform assemblies 1002*a-n* may include a spring 1202 disposed therein (as shown best in FIG. 15). Each spring 1202 may be disposed within each of the plurality of platform assemblies 1002*a-n*, and may be operably configured to compress and apply a force on each of the respective plurality of sleeved cosmetic enclosures 1000*a-n* within each of the plurality of independent channels 1100*a-n*. The biasing force applied by the spring 1202 may be in a direction toward the first end 108 of the cosmetic case body 104 (represented in FIG. 15 as arrow).

Referring primarily to FIGS. 12-16, in one embodiment, at least one of the plurality of platform assemblies 1002*a-n* may include a cam assembly 1302. In one embodiment, the cam assembly 1302 may include a cam arm 1402, which may include a first end 1406 and a second end 1408. In one embodiment, the first end 1406 of the cam arm 1402 may be mechanically coupled to one of the plurality of platform assemblies 1002*a-n*, preferably such that the first end 1406 of the cam arm 1402 is proximal to the second end 110 of the cosmetic case body 104. In one embodiment, each of the plurality of sleeved cosmetic enclosures 1000*a-n* may be selectively translatably coupled to one of the plurality of platform assemblies 1002*a-n* through the cam assembly 1302. More particularly, in one embodiment, the second end 1408 of the cam arm 1402 may be disposed within one of the plurality of sleeved cosmetic enclosures 1000*a-n*. In one embodiment, the first end 1406 of the cam arm 1402 and the second end 1408 of the cam arm 1402 may define and be separated by a cam arm length 1410. In one embodiment, the cam assembly 1302 may include a cyclical cam path 1404 that may be defined by one of the plurality of sleeved cosmetic enclosures 1000*a-n*. In one embodiment, the cyclical cam path 1404 may be defined by an outer surface 1008 of each of the plurality of sleeved cosmetic enclosures 1000*a-n*. In one embodiment, the cam arm 1402 may be operably configured to revolve within the cyclical cam path 1404.

Still referring to FIGS. 12-16, in one embodiment, each of the plurality of platform assemblies 1002*a-n* may include a snap tab 1204. In one embodiment, the snap tab 1204 includes a snap tab length 1504. In one embodiment, the snap tab 1204 may be of a rigid material, such as metal or plastic. In one embodiment, the snap tab 1204 may prevent one of the plurality of sleeved cosmetic enclosures 1000 from reaching the second end 110 of the cosmetic case body 104. More particularly, in one embodiment, the snap tab length 1504 of the snap tab 1204 may be of a particular size, selected to be greater than that of the cam arm length 1410, to prevent one of the plurality of sleeved cosmetic enclosures 1000*a-n* from being translated to the second end 1408 of the cam arm 1402, thereby preventing the one of the plurality of sleeved cosmetic enclosures 1000*a-n* from reaching the cam arm 1402 and the second end 110 of the cosmetic case body 104. The plurality of platform assemblies 1002*a-n* may also include snaps to couple with the body 104. In other embodiments, the plurality of platform assemblies 1002*a-n* may be coupled and frictionally retained to the body 104 through the shape and/or size of the two in relation to one another.

Referring again to FIGS. 1-5, the cosmetic case cover 102 may be selectively removably coupled to the cosmetic case body 104. For example, in one embodiment the cosmetic case cover 102 and the cosmetic case body 104 may be coupled by a hinge. In another embodiment, the cosmetic case cover 102 may be coupled to the cosmetic case body 104 by a channel including a track. In a further embodiment, the cosmetic case cover 102 may be frictionally retained by the cosmetic case body 104. Said another way, the cosmetic case cover 102 may be sized and shaped to be received by an interior edge of the cosmetic case body 104, thereby retaining the cosmetic case cover 102; alternatively, the cosmetic case cover 102 may be sized and shaped to receive an exterior edge of the cosmetic case body 104, thereby retaining the cosmetic case body 104.

Figure 4:
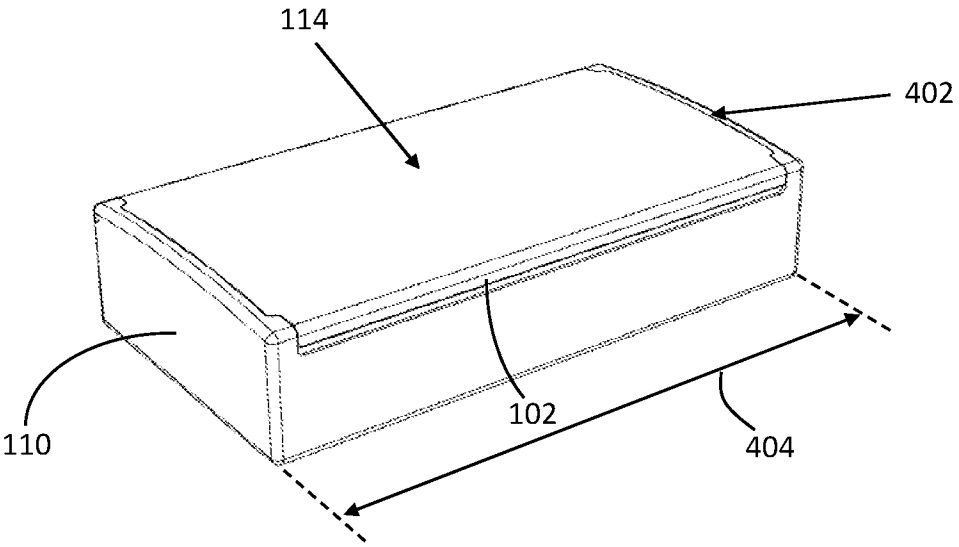
FIG. 4 is a perspective view of the top, front, and side of the cosmetic case and dispenser assembly of FIG. 1 in accordance with the present invention.

Referring particularly to FIGS. 4-5, regardless of the coupling mechanism, the cosmetic case cover 102 and cosmetic case body 104 are operably designed such that the cosmetic case and dispenser assembly 100 may be opened and closed. This opening may be accomplished by having the cosmetic case cover 102 be hingedly coupled to the cosmetic case body 104 through a joint 510. The joint 510 may be disposed proximal to a first outer longitudinal edge of the cosmetic case cover 514 and a first longitudinal outer edge of the cosmetic case body 512. In another embodiment, the opening of the cosmetic case and dispenser assembly 100 may be accomplished by coupling the cosmetic case cover 102 to the cosmetic case body 104 through a channel and track configuration, in which the cosmetic case cover 102 may be translated along the track and within the channel that is defined by the cosmetic case body 104. In a further embodiment, the cosmetic case and dispenser assembly 100 may be opened by entirely removing the cosmetic case cover 102 from the cosmetic case body 104, such as when the cosmetic case cover 102 is frictionally retained to the cosmetic case body 104.

Regardless of the coupling mechanism, the cosmetic case cover 102 may be operably configured to enclose, together with the cosmetic case body 104, the upper cavity 508 of the cosmetic case body 104. In one embodiment, this enclosure may be accomplished by translating the cosmetic case cover 102 from an open position along a cover translation path 516 to a closed position along a cover translation path 402. One example of a cover translation path is shown in FIGS. 4-5 (represented by arrow 518), but it is appreciated that other cover translation paths are possible, such as a cover translation path in which the cosmetic case cover 102 may be slidably removably translated along the first outer longitudinal edge of the cosmetic case cover 514 and the first outer longitudinal edge of the cosmetic case body 512, or a cover translation path in which the cosmetic case cover 102 may be frictionally retained by the cosmetic case body 104 and removable from the cosmetic case body.

Referring now to FIGS. 7-11 and 14-16, one method of using the cosmetic case and dispenser assembly 100 is shown. At least one of the plurality of sleeved cosmetic enclosures 1000*a-n* may be disposed within at least one of the plurality of independent channels 1100*a-n* through the first end aperture 904 of the cosmetic case body 104 at a first position along a sleeved cosmetic enclosure translation path 1102. The first position along the sleeved cosmetic enclosure translation path 1102 may be proximal to the first end 108 of the cosmetic case body 104. As used herein, "proximal" means adjacent to and flush with, plus or minus approximately 0.2". In another embodiment, the first position along the sleeved cosmetic enclosure translation path 1102 may be recessed within the first end 108 of the cosmetic case body 104. Regardless of whether the first position along the sleeved cosmetic enclosure translation path 1102 is proximal to and/or recessed within the first end 108 of the cosmetic case body, in the first position along the sleeved cosmetic enclosure translation path 1102, the upper surface 602 of the cap 206 may be disposed a first cap-offset-length 1508 from the one of the plurality of platform assemblies 1600.

At least one of the plurality of sleeved cosmetic enclosures 1000*a-n* may translate to a second position along a sleeved cosmetic enclosure translation path 1102 from the first position along the sleeved cosmetic enclosure translation path 1102. In one embodiment, at the second position along the sleeved cosmetic enclosure translation path 1102, the upper surface 602 of the cap 206 may be disposed a second cap-offset-length 1508 from the one of the plurality of platform assemblies 1002*a-n*. In one embodiment, the second cap-offset-length 1508 may be greater than the first cap-offset-length 1508. Said differently, as the sleeve cosmetic enclosures 1000*a-n* translate with respect to respective platform assemblies 1002*a-n*, in one position they are further offset from the respective platform assembly to which it is coupled so as to provide a user quick and easy access thereto. In a preferred embodiment, the upper surface 602 of the cap 206, when at the second cap-offset-length 1508, may be disposed in the ambient environment surrounding the cosmetic case body 104 at a length spatially removed from the first end 108 of the cosmetic case body 104 (as best shown in FIG. 9).

In one embodiment, the translation of the one of the plurality of sleeved cosmetic enclosures 1000*a-n* between the first position along the sleeved cosmetic enclosure translation path 1102 and the second position along the sleeved cosmetic enclosure translation path 1102 may be accomplished by applying a force to one of plurality of sleeved cosmetic enclosures 1000*a-n*. More particularly, in one embodiment, applying a force to one of the plurality of sleeved cosmetic enclosures 1000 in a direction toward the second end 110 of the body 104 functions to compress the spring 1202, thereby disengaging the one of the plurality of sleeved cosmetic enclosures 1000*a-n* from one of the plurality of platform assemblies 1002*a-n*. Said differently, applying a force to the one of the plurality of sleeved cosmetic enclosures 1000*a-n* provides the impetus to initiate the cam arm 1402 along the cam path 1404. In another embodiment, the disengagement may be accomplished by another mechanism or process.

Regardless of the mechanism, in one embodiment, the first position along the sleeved cosmetic enclosure translation path 1102 and the second position along the sleeved cosmetic enclosure translation path 1102 may be limited by the one of the plurality of platform assemblies 1002*a-n*. In one embodiment, this limitation may be accomplished by the snap tab 1204, whereby the snap tab 1204 limits the translation of the one of the plurality of sleeved cosmetic enclosures 1000*a-n* by providing a rigid structure, requiring a force on the spring 1202 to translate the one of the plurality of sleeved cosmetic enclosures 1000*a-n* beyond the snap tab 1204 and through the first end aperture 904 of the cosmetic case body 104.

Figure 28:
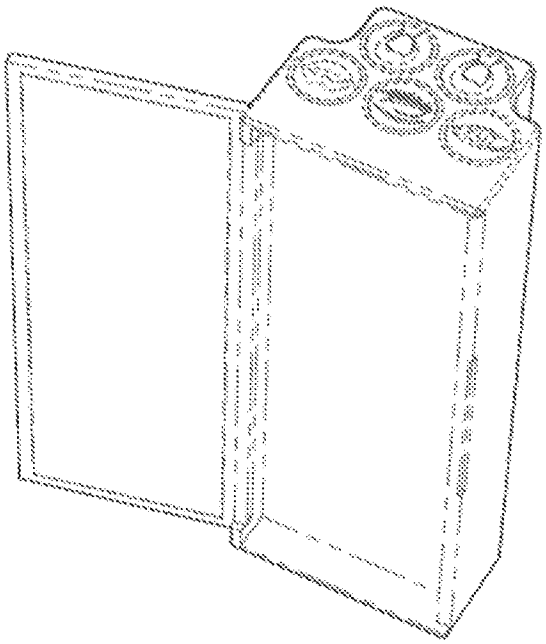
FIGS. 26-28 depict another embodiment of the cosmetic case and dispenser assembly in accordance with the present invention.
Figure 27:
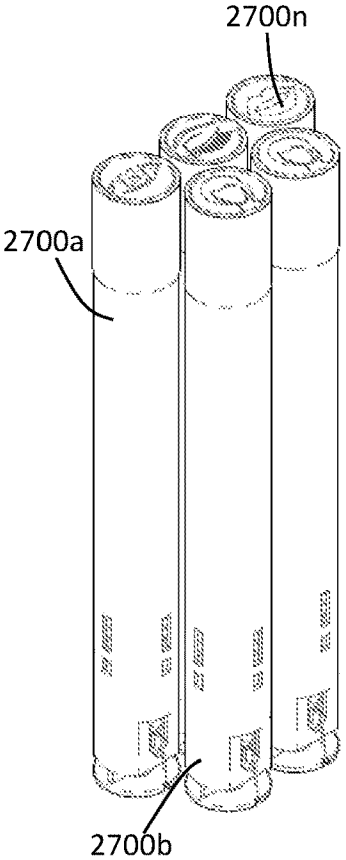
Figure 26:
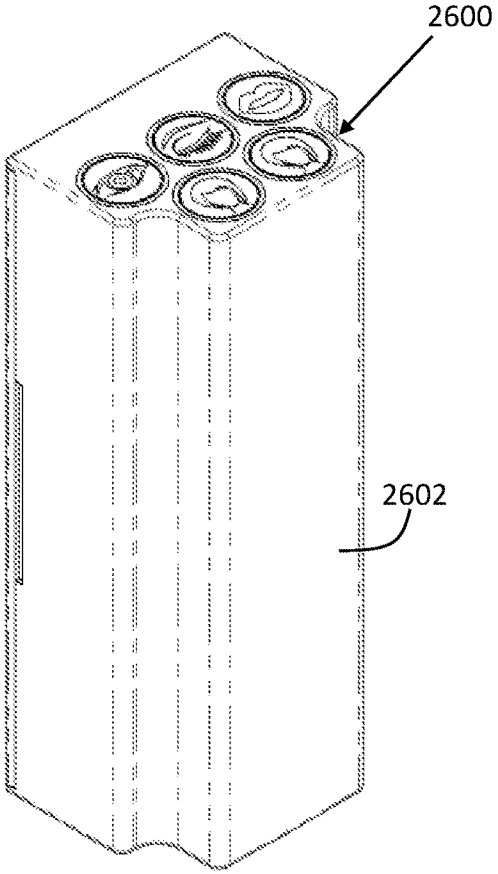

With reference to FIGS. 26-28, another embodiment of the cosmetic case and dispenser assembly 2600 is depicted. While various configurations and/or shapes of the body 2602 are possible, FIGS. 26-28 depict the body 2602 of the assembly 2600 shown in a compact configuration with the plurality of sleeved cosmetic enclosures 2700*a-n* disposed in a 3×2 configuration, thereby reducing the overall width of the body 2602 for more efficient storage of the body 2602.

A cosmetic case and dispenser assembly has been disclosed that may include a cosmetic case cover selectively removably coupled to a cosmetic case body, in which cosmetic items may be stored within sleeved cosmetic enclosures disposed within independent channels of the cosmetic case body. The sleeved cosmetic enclosures may be selectively translatably coupled to platform assemblies that may allow for the sleeved cosmetic enclosures to translate from a first position to a second position, in which the second position is extended away from the cosmetic case body, allowing a user to efficiently store and easily access a cosmetic item within one of the independent channels.

What is claimed is:

1. A cosmetic case and dispenser assembly comprising:

a cosmetic case cover having an upper surface and a bottom surface opposing the upper surface of the cosmetic case cover;

a cosmetic case body with the cosmetic case cover selectively removably coupled thereto, the cosmetic case body:

having a first end, a second end, and a body length separating the first and second ends of the cosmetic case body;

having a bottom surface and an upper surface defining an upper cavity thereon, the cosmetic case cover operably configured to enclose, with the cosmetic case body, the upper cavity when placed in a closed position along a cover translation path;

defining a plurality of independent channels each respectively:

spanning in a direction from a first end aperture defined by the first end of the cosmetic case body toward the second end of the cosmetic case body, the plurality of independent channels each spanning a length at least greater than 50% the body length; and interposed between the upper cavity and the bottom surface of the cosmetic case body; and having a plurality of removable platform assemblies, each respectively disposed within one of the plurality of independent channels and having a snap tab with a floor surface disposed at a first end disposed proximal to the second end of the cosmetic case body, a sidewall extending upwardly from the floor surface, and including a lateral flange disposed thereon and extending inwardly into each respective independent channel, the floor surface, sidewall, and lateral flange defining an enclosure recess; and a plurality of sleeved cosmetic enclosures each respectively:

disposed within one of the plurality of independent channels and having a cap selectively removably coupleable thereto;

including an outer surface at least partially defining a platform translation channel extending downwardly toward and disposed proximal to a bottom end of each of the plurality of sleeved cosmetic enclosures, the plurality of sleeved cosmetic enclosures each operably configured to be selectively translatably coupled to one of the plurality of platform assemblies with the lateral flange disposed within the platform translation channel and having a portion of the sleeved cosmetic enclosure disposed within the enclosure recess;

having a first position along a sleeved cosmetic enclosure translation path with an upper surface of the cap disposed a first cap-offset-length from the one of the plurality of platform assemblies and at least one of proximal to and recessed within the first end of the cosmetic case body; and having a second position along the sleeved cosmetic enclosure translation path with an upper surface of the cap disposed a second cap-offset-length from the one of the plurality of platform assemblies, wherein the second cap-offset-length is greater than the first cap-offset-length and the sleeved cosmetic enclosure translation path is at least partially limited by the contacting of the lateral flange of the one of the plurality of platform assemblies with the outer surface at least partially defining the platform translation channel; wherein when a sleeved cosmetic enclosure is removed from its respective independent channel, the sleeved cosmetic enclosure is removed along with the respective platform assembly coupled thereto.

2. The cosmetic case and dispenser assembly according to claim 1, wherein the second position further comprises:

the upper surface of the cap disposed in an ambient environment a length spatially removed from the first end of the cosmetic case body.

3. The cosmetic case and dispenser assembly according to claim 1, wherein:

the upper surface of each cap coupled to the plurality of sleeved cosmetic enclosures further comprises:

a cosmetic classification indicia disposed thereon, each cosmetic classification indicia having an independent visual representation corresponding to a cosmetic classification group.

4. The cosmetic case and dispenser assembly according to claim 1, wherein each of the plurality of platform assemblies respectively further comprises:

a spring disposed therein and operably configured to compress and apply a force on one of the plurality of sleeved cosmetic enclosures in a direction toward the first end of the cosmetic case body.

5. The cosmetic case and dispenser assembly according to claim 1, wherein:

each of the plurality of sleeved cosmetic enclosures is respectively selectively translatably coupled to the one of the plurality of platform assemblies through a cam assembly.

6. The cosmetic case and dispenser assembly according to claim 5, wherein the cam assembly further comprises:

a cam arm with a first end mechanically coupled to the one of the plurality of platform assemblies and a cyclical cam path defined by each of the respective plurality of sleeved cosmetic enclosures.

7. The cosmetic case and dispenser assembly according to claim 6, wherein:

the cyclical cam path is defined by the outer surface of each of the respective plurality of sleeved cosmetic enclosures, the cyclical cam path having a second end of the cam arm disposed within the one of the respective plurality of sleeved cosmetic enclosures and operably configured to revolve therein.

8. The cosmetic case and dispenser assembly according to claim 1, wherein the cosmetic case cover further comprises:

a mirror disposed on the bottom surface of the cosmetic case cover.

9. The cosmetic case and dispenser assembly according to claim 1, wherein:

the cosmetic case cover is hingedly coupled to the cosmetic case about a joint disposed proximal to a first outer longitudinal edge of the cosmetic case cover and a first longitudinal outer edge of the cosmetic case body.

10. The cosmetic case and dispenser assembly according to claim 1, wherein:

each of the respective plurality of platform assemblies are selectively removably coupled to a bottom end of each of the respective plurality of cosmetic sleeve enclosures with the snap tab.

11. A cosmetic case and dispenser assembly comprising:

a cosmetic case cover having an upper surface and a bottom surface opposing the upper surface of the cosmetic case cover;

a cosmetic case body with the cosmetic case cover selectively removably coupled thereto, the cosmetic case body:

having a first end, a second end, and a body length separating the first and second ends of the cosmetic case body;

having a bottom surface and an upper surface opposing the bottom surface of the cosmetic case body;

defining a first independent channel and a second independent channel, the first and second independent channels each respectively:

spanning in a direction from a first end aperture defined by the first end of the cosmetic case body toward the second end of the cosmetic case body; and interposed between the upper surface and the bottom surface of the cosmetic case body; and having a first removable platform assembly and a second removable platform assembly, the first and second platform assemblies each respectively:

disposed within either the first independent channel or the second independent channel;

having a snap tab with a floor surface disposed at a first end and including a sidewall extending upwardly from the floor surface and lateral flange disposed thereon and extending inwardly into each respective independent channel, the floor surface, sidewall, and lateral flange defining an enclosure recess;

proximal to the second end of the cosmetic case body; and having a spring disposed therein; and a first sleeved cosmetic enclosure and a second sleeved cosmetic enclosure, the first and second sleeved cosmetic enclosures each respectively:

disposed within either the first independent channel or the second independent channel and having a cap selectively removably coupleable thereto;

including an outer surface at least partially defining a platform translation channel extending downwardly toward and disposed proximal to a bottom end of each of the first and second sleeved cosmetic enclosures, the first and second sleeved cosmetic enclosures each operably configured to be selectively translatably coupled to either the first platform assembly or the second platform assembly with the lateral flange disposed within the platform translation channel and having a portion of the sleeved cosmetic enclosure disposed within the enclosure recess;

having a first position along a sleeved cosmetic enclosure translation path with an upper surface of the cap disposed a first cap-offset-length from either the first platform assembly or the second platform assembly and at least one of proximal to and recessed within the first end of the cosmetic case body; and having a second position along the sleeved cosmetic enclosure translation path with an upper surface of the cap disposed a second cap-offset-length from either the first platform assembly or the second platform assembly, wherein the second cap-offset-length is greater than the first cap-offset-length and the sleeved cosmetic enclosure translation path is at least partially limited by the contacting of the lateral flange of either the first platform assembly or the second platform assembly with the outer surface at least partially defining the platform translation channel, wherein each spring is operably configured to compress and apply a force on each of the first sleeved cosmetic enclosure or the second sleeved cosmetic enclosure in a direction toward the first end of the cosmetic case body; wherein when a sleeved cosmetic enclosure is removed from its respective independent channel; the sleeved cosmetic enclosure is removed along with the respective platform assembly coupled thereto.

12. The cosmetic case and dispenser assembly according to claim 11, wherein the second position further comprises:

the upper surface of the cap disposed in an ambient environment a length spatially removed from the first end of the cosmetic body.

13. The cosmetic case and dispenser assembly according to claim 11, wherein the upper surface of each cap coupled to either the first sleeved cosmetic enclosure or the second sleeved cosmetic enclosure further comprises:

a cosmetic classification indicia disposed thereon, each cosmetic classification indicia having an independent visual representation corresponding to a cosmetic classification group.

14. The cosmetic case and dispenser assembly according to claim 11, wherein:

the first sleeved cosmetic enclosure and the second sleeved cosmetic enclosure are each respectively translatably coupled to each of the first platform assembly and the second platform assembly through a first cam assembly and a second cam assembly.

15. The cosmetic case and dispenser assembly according to claim 14, wherein the first cam assembly and the second cam assembly each respectively further comprises:

a cam arm with a first end mechanically coupled to either the first platform assembly or the second platform assembly, the cam arm defined by a cam arm length; and a cyclical cam path defined by each of the respective first sleeved cosmetic enclosure and second sleeved cosmetic enclosure.

16. The cosmetic case and dispenser assembly according to claim 15, wherein:

the cyclical cam path is defined by the outer surface of each of the respective first sleeved cosmetic enclosure and second sleeved cosmetic enclosure, the cyclical cam path having a second end of the cam arm disposed within either the first sleeved cosmetic enclosure or the second sleeved cosmetic enclosure and operably configured to revolve therein.

17. The cosmetic case and dispenser assembly according to claim 11, wherein each of the first platform assembly and the second platform assembly each respectively further comprises:

a snap tab, wherein the first platform assembly and the second platform assembly are each respectively selectively removably coupled to a bottom end of each of the first sleeved cosmetic enclosure and the second sleeved cosmetic enclosure respectively with the snap tab.

18. The cosmetic case and dispenser assembly according to claim 17, wherein:

the sleeved cosmetic enclosure translation path is limited by the snap tab.

19. The cosmetic case and dispenser assembly according to claim 18, wherein:

the first sleeved cosmetic enclosure and the second sleeved cosmetic enclosure are each respectively translatably coupled to each of the first platform assembly and the second platform assembly through a first cam assembly and a second cam assembly, the first cam assembly and the second cam assembly each respectively having a cam arm with a first end mechanically coupled to either the first platform assembly or the second platform assembly, the cam arm defined by a cam arm length, wherein the snap tab length is greater than the cam arm length.

20. The cosmetic case and dispenser assembly according to claim 11, wherein the cap further comprises:

an outer surface and an inner surface opposite the outer surface, the inner surface:

made of a silicone material; and defining an inner surface cavity, wherein the inner surface of the cap is operably configured to frictionally retain a cosmetic item within the inner surface cavity.

* * * * *